US010709230B1

(12) United States Patent
Aday

(10) Patent No.: US 10,709,230 B1
(45) Date of Patent: Jul. 14, 2020

(54) BEVERAGE CONTAINER CARRIER

(71) Applicant: Adrian Aday, Miami, FL (US)

(72) Inventor: Adrian Aday, Miami, FL (US)

( * ) Notice: Subject to any disclaimer, the term of this patent is extended or adjusted under 35 U.S.C. 154(b) by 0 days.

(21) Appl. No.: 16/269,539

(22) Filed: Feb. 6, 2019

(51) Int. Cl.
*A45F 5/00* (2006.01)
*A45F 5/10* (2006.01)

(52) U.S. Cl.
CPC ..... *A45F 5/102* (2013.01); *A45F 2005/006* (2013.01); *A45F 2200/0583* (2013.01)

(58) Field of Classification Search
CPC ..... A45F 5/105; A45F 2200/0583; A45F 2005/006
USPC ..... 224/148.4, 148.5, 148.6, 268, 269, 666
See application file for complete search history.

(56) References Cited

U.S. PATENT DOCUMENTS 2,806,731 A * 9/1957 Comstock, Jr. ..... B65D 23/104 294/27.1
2,970,729 A * 2/1961 Allen ..... A47J 47/16 294/149
3,369,723 A * 2/1968 Saari ..... A45F 5/02 224/148.6
5,402,971 A * 4/1995 Bower ..... F16L 3/233 24/16 PB
5,664,711 A * 9/1997 Mellon ..... A45D 29/22 132/73
5,992,715 A * 11/1999 Habibi ..... A45F 3/18 222/175
D427,510 S * 7/2000 Gary ..... D26/138
6,131,780 A * 10/2000 Becker ..... A45F 3/04 224/148.6
6,626,333 B2 * 9/2003 Levesque ..... A45F 3/04 215/399
D491,465 S * 6/2004 Kelleghan ..... D3/229
D496,588 S * 9/2004 Matsuo ..... D9/434
6,837,472 B1 * 1/2005 Beutz ..... A45F 3/16 224/148.4
6,857,544 B2 * 2/2005 Dahl ..... A45F 3/14 224/148.4
D510,018 S * 9/2005 Tognolini ..... D8/395
D590,714 S * 4/2009 Sanders ..... D7/622
(Continued)

FOREIGN PATENT DOCUMENTS

AT 10743 U1 * 9/2009 ..... A45F 5/02
DE 102013223655 A1 * 5/2014 ..... A45C 3/001
(Continued)

*Primary Examiner* — Justin M Larson
(74) *Attorney, Agent, or Firm* — Susan Dierenfeldt-Troy

(57) ABSTRACT

The invention describes a device for carrying beverage cans and bottles comprising a can clip element, a beverage bottle connector cord element and a grasper cord element. The three elements are intended to cooperate as one unit for use with cans and bottles. The can clip element's one-piece design comprising a proximal loop for securing a grasper element and a can engagement slot allows it to be reversibly secured to the top of an opened beverage. The design provides for easy carrying and does not interfere with the user's ability sip the contents of the opened container. The bottle securing attachment element allows it to be easily adjusted around the neck of a beverage bottle regardless of the neck's diameter. The design further allows the user to have both features available within one self-contained unit for use with beverage bottles or beverage cans, whatever the preference may be.

11 Claims, 13 Drawing Sheets

(56) References Cited

U.S. PATENT DOCUMENTS

D594,745 S * 6/2009 Hecht ..... D9/434
7,614,532 B1 * 11/2009 Dague ..... A45F 5/02 224/148.7
D657,134 S * 4/2012 Tepper ..... A45F 5/00 D3/215
8,272,545 B1 * 9/2012 Saffran ..... A45F 5/00 224/148.4
D703,040 S * 4/2014 White ..... D9/434
D745,743 S * 12/2015 Reukema ..... D29/101.1
D764,803 S * 8/2016 Chiou ..... D3/327
D861,487 S * 10/2019 Webb ..... D9/455
10,531,753 B1 * 1/2020 Cleveland ..... B65D 51/245
2005/0109803 A1 * 5/2005 Shin ..... A45F 3/16 224/148.4
2005/0173477 A1 * 8/2005 Scott ..... A45F 5/02 224/148.6
2005/0274753 A1 * 12/2005 Swentor ..... A45F 5/10 224/148.6
2007/0235492 A1 * 10/2007 Sirichai ..... A45C 11/00 224/675
2008/0061091 A1 * 3/2008 Mailliard ..... A45F 5/02 224/148.6
2008/0203127 A1 * 8/2008 Castillo-Garrison ..... A45C 13/30 224/607
2010/0025441 A1 * 2/2010 Blaney ..... A45F 5/02 224/148.6
2012/0018469 A1 * 1/2012 Fisher ..... A45F 5/00 224/218
2013/0098958 A1 * 4/2013 Caccialino ..... A45F 5/00 224/267
2015/0121662 A1 * 5/2015 DeGrouchy ..... A45F 5/021 24/316
2016/0214784 A1 * 7/2016 Caldwell ..... A45C 3/00
2017/0150804 A1 * 6/2017 Belzner ..... A45F 5/00
2018/0153285 A1 * 6/2018 Tanaka ..... B65D 25/22

FOREIGN PATENT DOCUMENTS

DE 102017107321 A1 * 10/2018 ..... A45F 5/021
FR 2856901 B1 * 7/2005 ..... B65D 47/089
WO WO-2013163725 A1 * 11/2013 ..... A45F 5/10
WO WO-2013169124 A2 * 11/2013 ..... A45F 5/00
WO WO-2013169124 A3 * 3/2014 ..... A45F 5/00
WO WO-2015030936 A1 * 3/2015 ..... A61J 9/0661
WO WO-2017168744 A1 * 10/2017 ..... A45F 5/102

* cited by examiner

200

BEVERAGE CONTAINER CARRIER

PRIORITY CLAIM

This applicant claims priority to provisional patent application 62/626,755 filed on Feb. 6, 2018

BACKGROUND OF THE INVENTION

Beverages are often packaged in cans or bottles purchased at a variety of locations including but not limited to convenience stores, grocery stores, amusement parks, sports events, and fast food restaurants. Beverage consumers often wish to take the beverage container with them so that they can consume the beverage over a period of time rather than consume the purchased beverage in one location. It is not unusual to see beverage consumers walking around with a beverage bottle or can in their hands and taking occasional sips as they go about their daily activities.

The handling of beverage containers requires the handler to grasp onto the container with one hand, thereby preventing the handler from using the beverage-occupied hand for other purposes. To accomplish a task requiring the handler's grasping hand, the container handler will generally need to first set the container down. Consumers also often set down their beverage containers between sips to avoid continuous handling of the containers. Depending upon where it is set down, the open container's liquid contents could become exposed to undesirable substances such as dust, insects, the germs of another if someone takes a sip from the container, or even substances such as drugs that could be added to the open container by someone for nefarious purposes without the beverage consumer's knowledge.

Once the beverage container is opened, caution in handling the container must be used to ensure that the remaining liquid contents do not spill. Can containers in particular may difficult to maintain in an upright position over an extended period of time. Also, small children and adults with arthritic hands may well have a difficult time grasping beverage containers in general.

The disclosed invention addresses the above problems through a device that provides for the holding and conveying of both opened bottle and opened can beverage containers. The device eliminates the need for the beverage consumer to actually grasp the container itself except for when the beverage is actually being consumed.

DESCRIPTION OF THE INVENTION

Figure 1A:
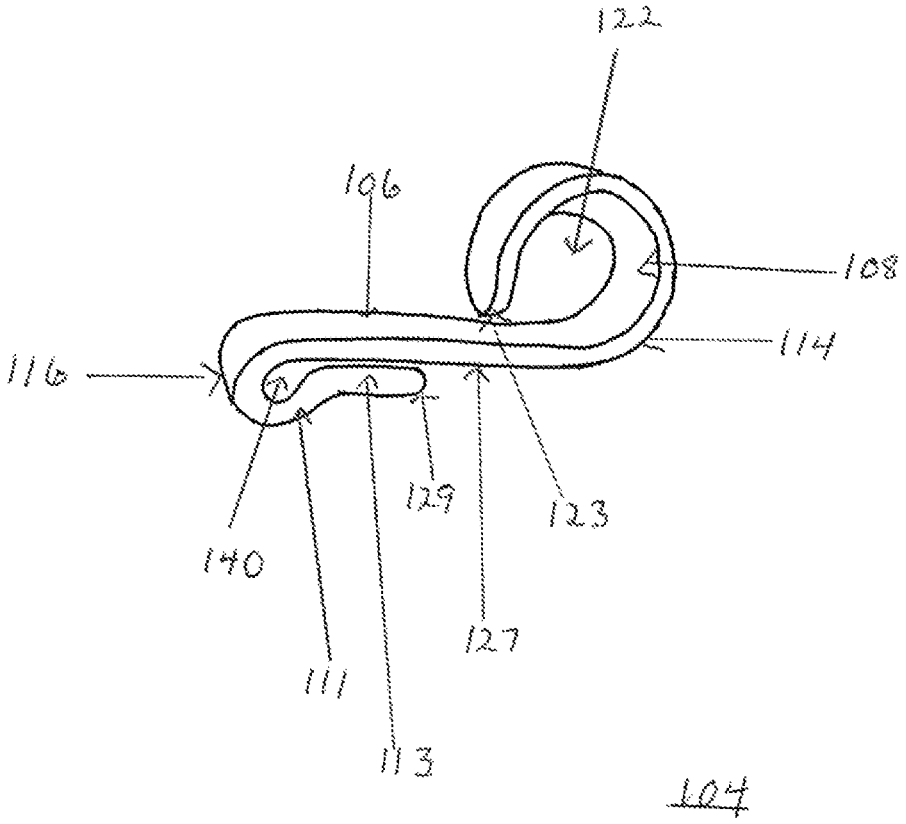
FIG. 1A is front perspective view of the device's can clip element.
Figure 1B:
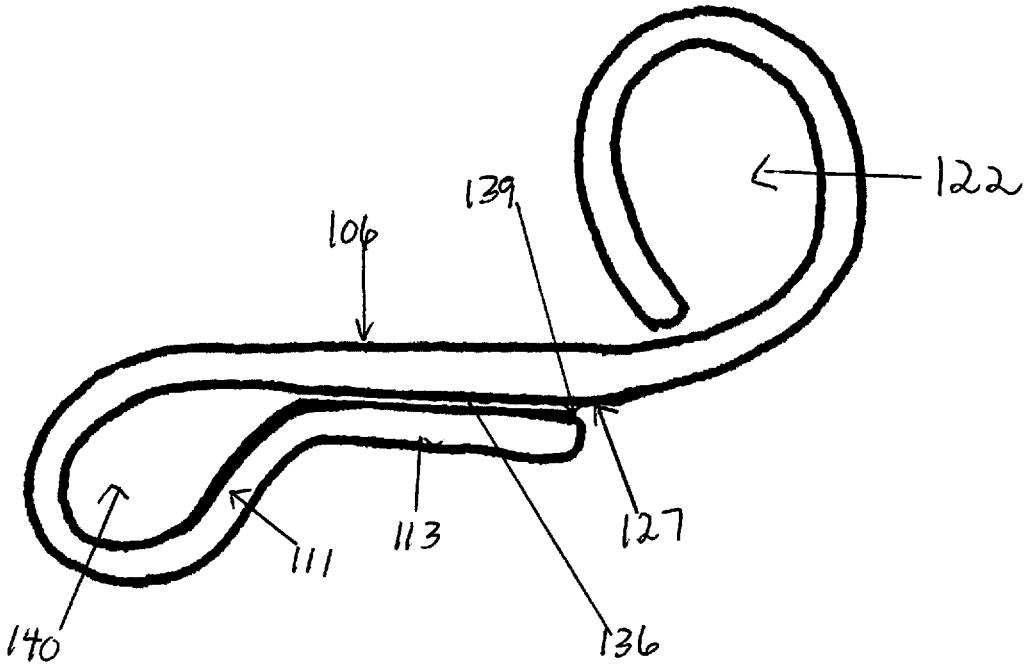
FIG. 1B is a side view of the device's clip can element.
Figure 1C:
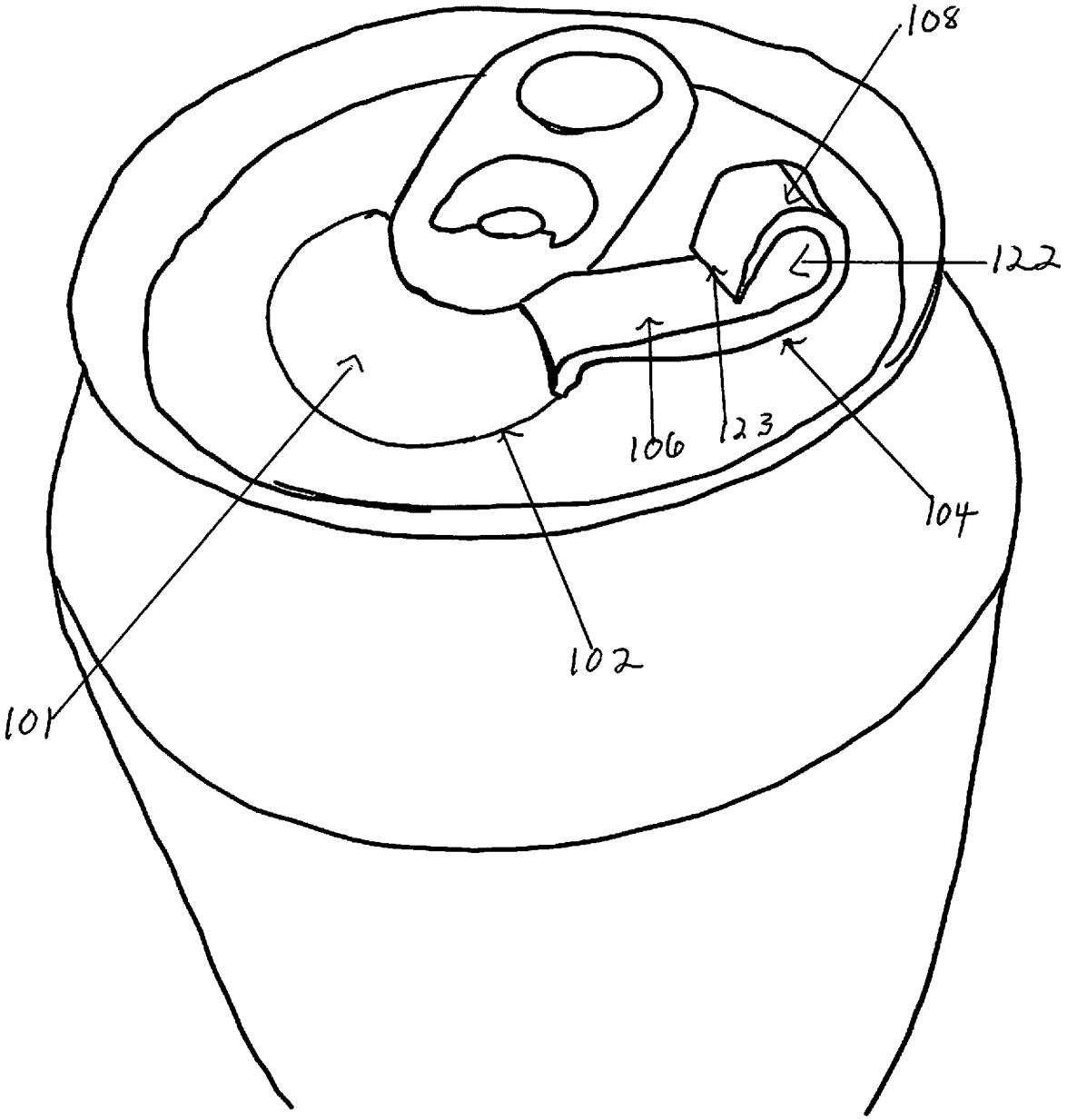
FIG. 1C is a perspective view of an opened beverage can with the attached can clip element.
Figure 2:
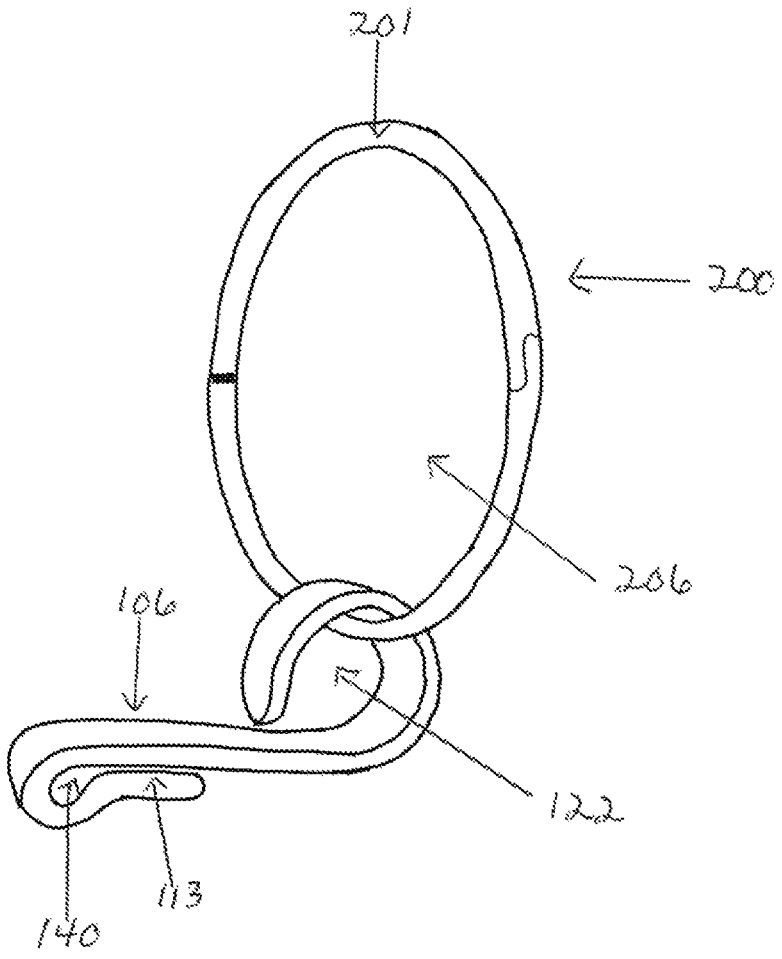
FIG. 2 is a perspective view of the device's can-clip element that includes a detachable grasping handle element.

Referring to FIGS. 1A-C, 2, 3 and 7A-E, an embodiment of the device 10 provides for the carrying of beverage can 100 such as soda and beer cans which have a flip top type of opener. Once the flip top is opened as shown in the referenced figures, the top side of the beverage can container contains a substantially circular opening 101 bordered by thin edge 102 through which the user sips the beverage can's liquid contents.

Referring again to FIGS. 1 and 2, device 10 comprises an inventive one-unit can clip element 104 constructed from a substantially rectangular piece of solid, non-flexible material such as stainless steel. The finished can-clip element has a top proximal loop member 108, a top substantially rectangular member 106 and a distal bottom arm member 110 comprising an angled section 111 contiguous with rectangular projection 113 which extends horizontally along the bottom side 127 of rectangular member 106. As the result of the shape of the distal bottom arm member 110, the can clip element 104 includes a small substantially circular aperture 140. The proximal loop member 108 and bottom arm member 110 are formed by altering the conformation of the rectangular piece of solid, substantially non-flexible material through mechanical means to achieve the self-contained can clip element 104.

The resultant proximal loop member 108 has a substantially circular opening 122. Tip 123 of the proximal loop member abuts or is just slightly above the top side 125 of clip can element 104. Rectangular projection 113 terminates in tip 129. Tips 123 and 129 comprise the ends of clip element 104. Tip 129 does not abut the bottom side 127 of clip element 104. Rectangular projection 113 is substantially horizontal with and aligned with the bottom side 127 of can clip element 104.

Figure 3:
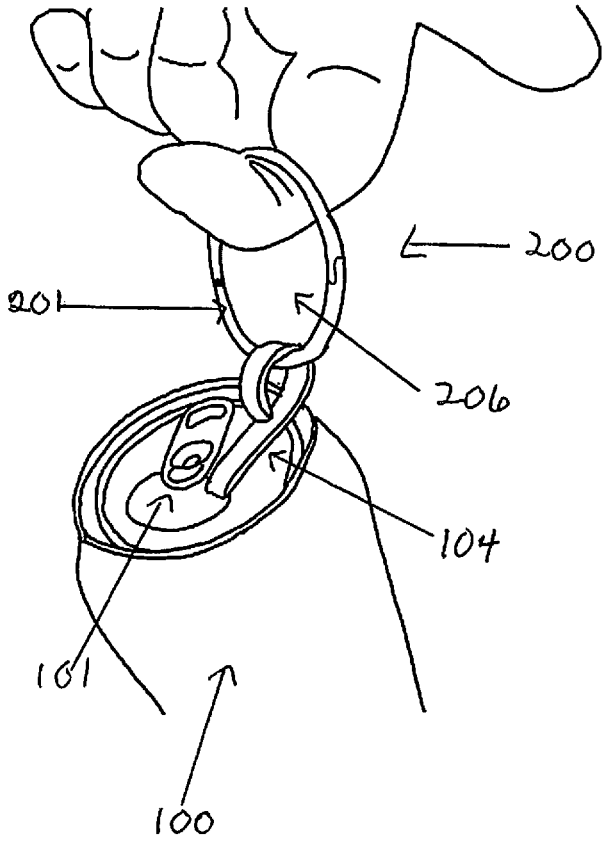
FIG. 3 is a perspective view showing the device's can clip element with a grasping handle element reversibly secured to an opened beverage can.

Rectangular projection 113 is separated from the bottom side 127 of clip can element 104 by a narrow, substantially horizontal can engagement slot 136 having an external rectangular opening 139 and extending horizontally from opening 139 to internal circular aperture 140. Together, engagement slot 136 and internal circular aperture 140 provide for a secure but slidingly reversibly engagement of the can clip element 104 with the top side of opened beverage can 100 as shown in FIG. 3.

FIG. 1 shows can clip element 104 wherein the rectangular top member 106 is longer than the distal bottom arm member 110. The relative difference in length is not essential to practice the invention.

Referring again to FIGS. 1, 2, and 7, can clip element 104 is the portion of the device 10 in direct contact with opening 101 of an opened beverage can. To engage can clip element 104 with an opened beverage can, the user aligns the external rectangular opening 139 of engagement slot 132 with the thin edge 102 of the opened beverage can.

Once proper alignment with rectangular opening 139 is achieved, the user pulls on proximal loop member 108 until the inner lateral wall 141 of small internal aperture 140 comes into contact with the beverage can. Full engagement between the can clip element 104 and the can's top side is achieved when the opened can's thin edge 102 is in contact with the inner lateral wall 141.

To disengage clip element 104 from the can, the user slides the clip element 104 generally by grasping proximal loop member 108 and pulling the can clip element 104 in the direction opposite from the direction used to insert can clip element 104 until the can clip element 104 is fully disengaged from the can. The user can also effect removal of clip can element 104 by pushing on proximal loop member 108 to cause the clip can element 104 to slide off of the top side 103 of can 100.

Referring again to FIG. 3, the overall length 144 of can clip element 104 is preferably smaller than the diameter of the can's opening 101 such that can proper engagement and disengagement of can clip element 104 can be achieved without substantial interference from the can 100'sedge 102. Also, once properly engaged with the top of beverage can 100, the clip element 104 element preferably does not substantially protrude into the can's opening 101 to cause interference with the user's sipping of the can's liquid contents.

Figure 4:
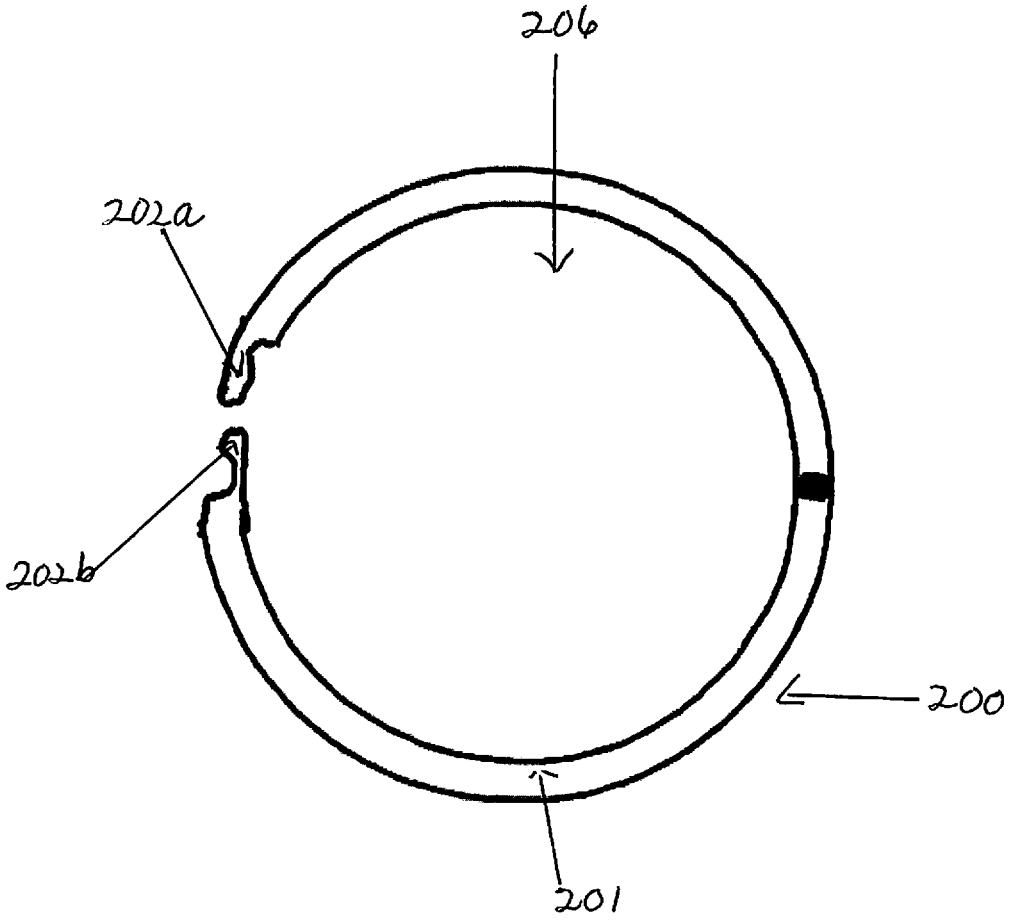
FIG. 4 is a perspective view of an embodiment of the device's detachable container grasping handle element before insertion through the can clip element's proximal loop.

Referring again to FIGS. 2, 3, and 4, the proximal loop member 108 of can clip element 104 is the structure to which the invention's user grasping handle element 200 is reversibly attached to can clip element 104 to provide device 10. That is, device 10 comprises both can clip element 104 and grasping handle element 200 when in use. In an embodiment, grasping handle 200 has a solid substantially circular cord 201 with two complementary opposite ends 202*a* and 202*b* which are reversibly attached together after insertion of end 202*a* or 202*b* through opening 122 of proximal loop member 108 to provide grasping handle element 200 with opening 206. The inclusion of grasping handle element 200 on clip can element 104 does not interfere with the user's ability to engage and disengage the can clip element 104 from a beverage can.

Device 10 allows the user to free up her hands for additional uses and further allow allows the user to connect the open beverage can to a purse strap, backpack strap, belt and the like for totally hands-free transport of an open beverage can. Also, the size of the grasper handling element 200 cord may be varied depending upon the user's preferences and needs. Thus a short cord 200 provides opening 206 which may be desirable if, for example, the user wishes to secure an opened can to a purse strap, backpack strap, bicycle bar, or even a belt. If the opened can is to be transported by hand, the user may use a larger grasper handling element 200 to allow insertion of her entire hand through a larger opening 206. Either way, the can clip element 104 in conjunction with user grasping element 200 allows the user to carry an opened can comfortably.

Although they have a different shape from a beverage can container, beverage bottles suffer from some of the same handling and transport issues as beverage cans. Referring now to FIGS. 5A-5C, 6 and 7, another embodiment the device 10, when combined with clip element 104, also provides for transporting of beverage bottles of any size, material, or weight (e.g., plastic or stainless steel).

Figure 5A:
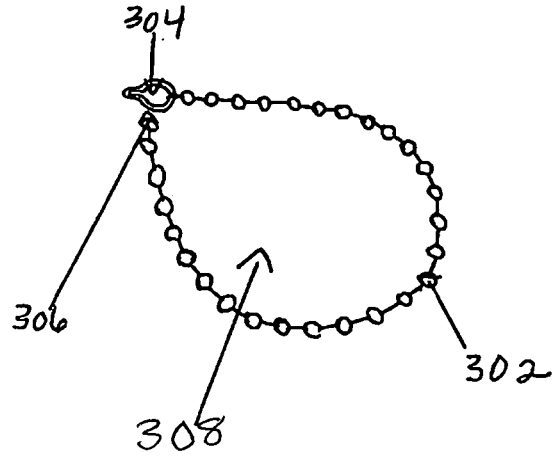
FIGS. 5A, 5B, and 5C are front perspective views of the device's beverage bottle securing cord element.
Figure 5B:
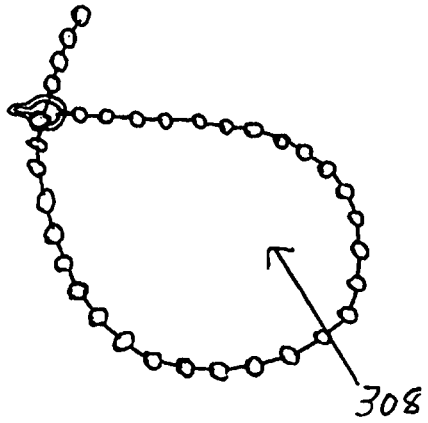
Figure 5C:
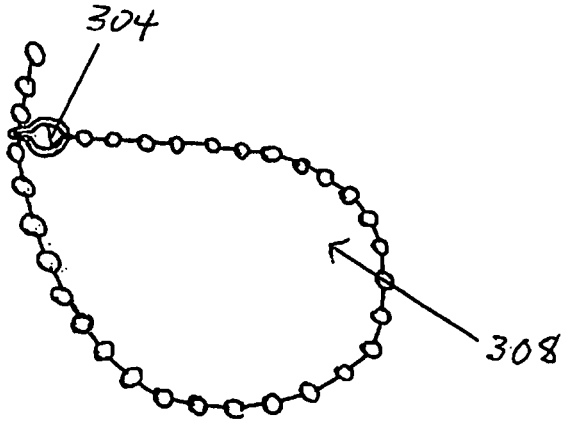
Figure 6:
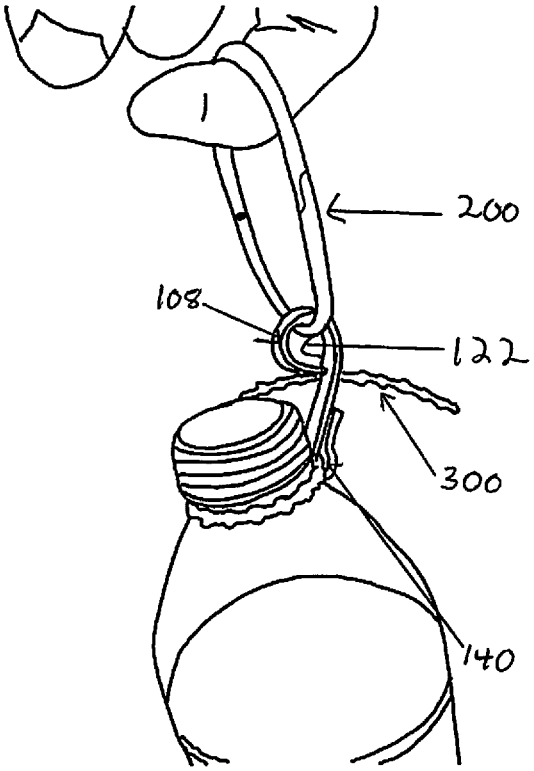
FIG. 6 is a perspective view showing the interplay between the device's can clip element, grasping handle element and the bottle securing cord element.
Figure 7A:
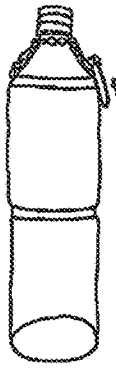
FIGS. 7A-7E show front perspective views of the device secured to a beverage can and beverage bottles having different bottle neck sizes.
Figure 7B:
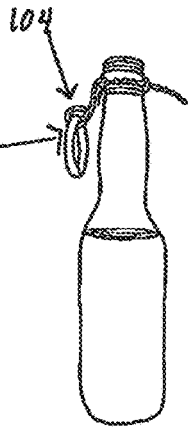
Figure 7C:
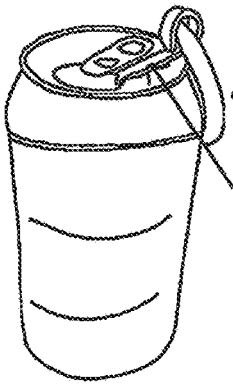
Figure 7D:
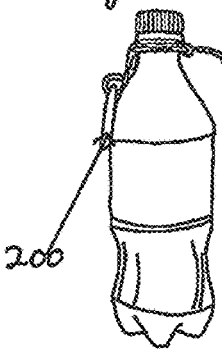
Figure 7E:
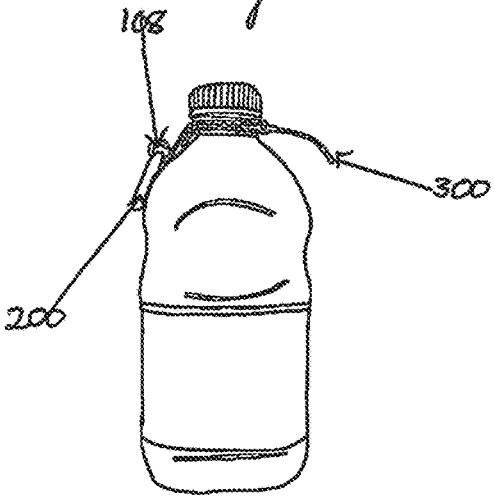

Referring to FIGS. 5A, 6, and 7, device 10 utilizes the can clip can element 104 disclosed above as a conduit for connecting the grasping handle element 200 disclosed above with a beverage bottle connector cord element 300. Bottle connector cord element 300 comprises a cord portion 301 including a plurality of evenly spaced protrusions 302 throughout its length, a protrusion engagement hook 304 at one end and an opposite free end 306. As shown in FIGS. 5B and 5C and 6, the bottle connector cord element 300 is reversibly secured to the neck of a beverage bottle by sliding the free end 306 of cord 301 through the protrusion engagement hook 304 to create a loop 308 which is inserted over the neck of a beverage bottle and adjusted in size by pulling free end 306 through protrusion engagement hook 304 until loop 308 is tightly secured around the neck of the beverage bottle. The user then engages the protrusion engagement hook 304 with the nearest protrusion 302 for achieving the desired tightness.

In this embodiment, the free end 306 of beverage connector cord element 300 is then inserted through small internal aperture 140 of can clip element 104. Small internal aperture 140 is large enough to accommodate the unhindered sliding of the cord 301's small protrusions 302 back and forth through the aperture 140 as desired by the user for achieving proper "fit" of the beverage bottle connector element 300 with a beverage bottle as shown in FIG. 6 and FIG. 7. As shown in FIGS. 6 and 7, clip can element 104 provides the beverage bottle user with the grasping handle element 200, thereby allowing for easy carrying of the beverage bottle.

Figure 8:
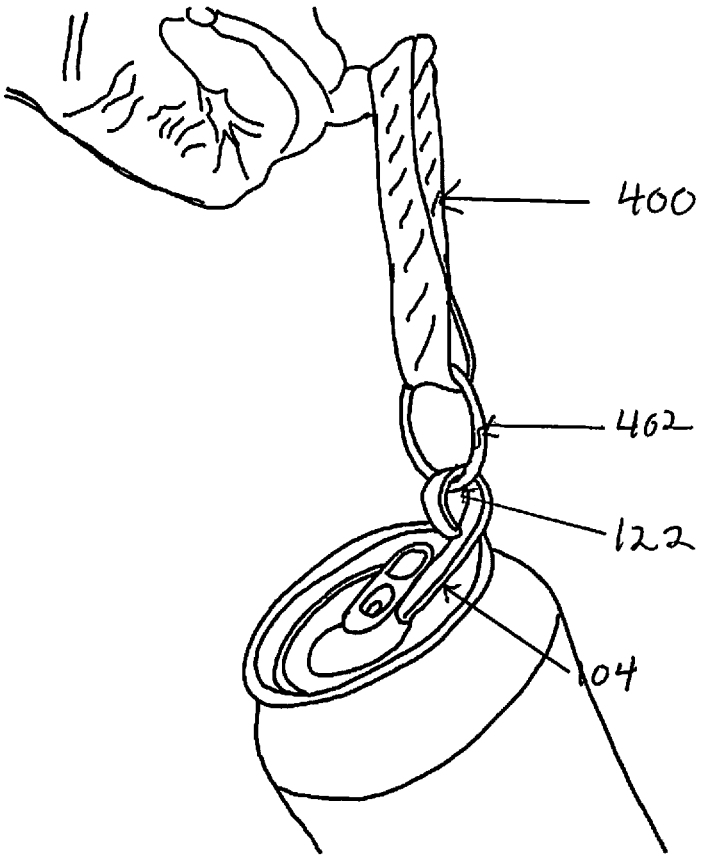
FIG. 8 shows a perspective view of the device showing an embodiment of the device's bottle securing cord element reversibly attached to the device's can-clip element when used with a beverage can.
Figure 9:
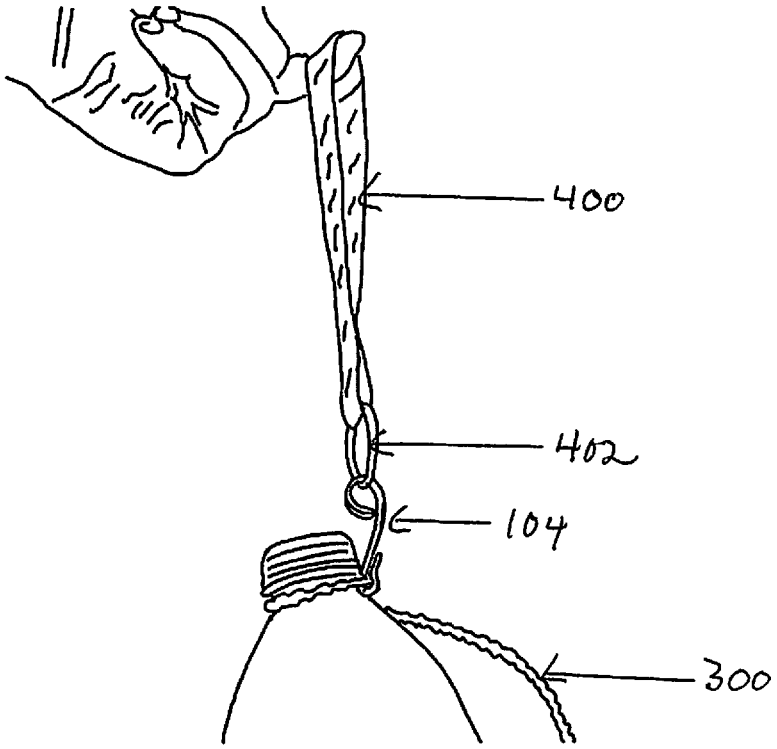
FIG. 9 shows a perspective view of the device showing an embodiment of the device's securing cord element reversibly attached to the device's can clip element when used with a beverage bottle.

Referring now to FIGS. 8 and 9, the grasping element 200 may be comprised of a flexible closed grasping strap 400 with a distal hook 402 for reversible attachment to proximal hook 108 of the can clip element 104.

Figure 10A:
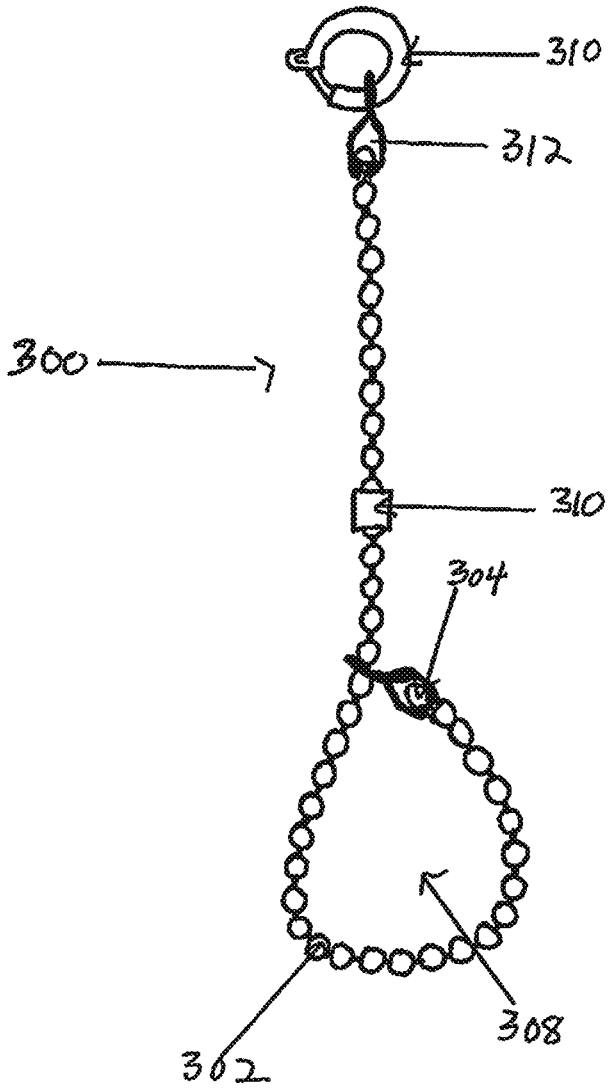
FIG. 10A is a perspective view of an embodiment of the device's beverage bottle securing cord showing the inclusion of the disclosed tightening fob.
Figure 10B:
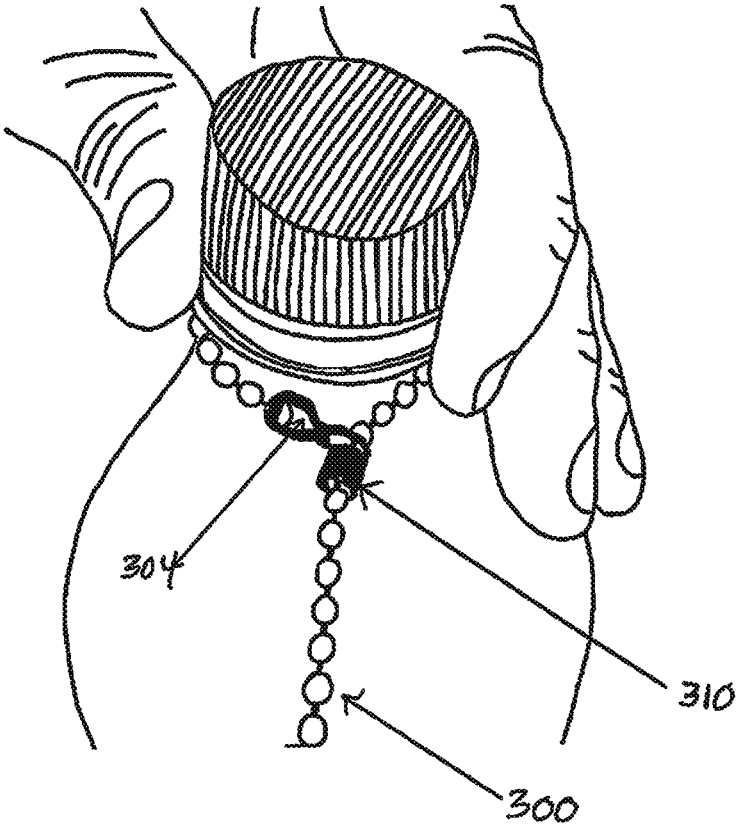
FIG. 10B is a perspective view showing the embodiment shown in FIG. 10A when in use.

Referring now to FIGS. 10A and 10B, in another embodiment of the device 10 for use with beverage bottles, the opposite free end 306 of cord 301 is now affixed to a small closed loop 312 for reversible insertion onto a clasp 310. In this embodiment, the bottle connector element 300 is connected to the clip can element 104 by hooking clasp 310 onto small internal aperture 140 of can clip element 104.

Referring again to FIGS. 10A and 10B, one important requirement for heavy beverage container bottles is to maintain the tightness of the loop 308 around the neck of the bottle. In an embodiment, the cord portion 301 includes a tightening fob 310. Once the loop 308 has been tightly secured around the neck of a bottle as disclosed above, the user slides the tightening fob 310 upwardly until it abuts the site where the protrusion engagement hook 304 is engaged with a protrusion 302.

The disclosed invention allows users to readily transport both beverage bottles, whether plastic or reusable, and disposable cans. One foreseeable safety-related benefit of the device is its usage by party attendees or bar attendees who may be apt to set down their containers when it becomes too cumbersome to constantly hold-on to the container. This may result in a mix-up of the containers or even allow the unknown introduction of drugs into the container unbeknownst to the person who set down the container. The device 100 allows beverage container users to always keep their containers close, thereby minimizing the possibility of a mix-up or the nefarious introduction of unknown substances.

The grasping handle element 200 and can clip element 104 may include logos and the like for advertising and promotional purposes. Additionally, the device may be provided as a kit with a variety of grasping handle 200 and/or 400 sizes.

The can clip element 104 for both of the embodiments disclosed above may be comprised of any strong, non-flexible material such as metal, stainless steel, plastic or a combination thereof. The container grasping cord 200 may be comprised of metal, plastic, natural or synthetic cloth or a combination thereof. The bottle securing cord element 300 may be comprised of metal, plastic, natural or synthetic cloth or a combination thereof.

Directional terms such as "front", "back", "in", "out", "downward", "upper", "lower", "top", "bottom", "proximal" or "distal" and the like may have been used in the description. These terms are applicable to the embodiments shown and described in conjunction with the drawings. The terms are merely used for the purpose of description in connection with the drawings and do not necessarily apply to the position in which the multi-washer apparatus may be used.

While the invention has been described with reference to various embodiments, it will be understood by those skilled in the art that various changes may be made and equivalents may be substituted for elements thereof without departing from the scope of the invention. In addition, many modifications could be made to adapt a particular situation or material to the teachings of the invention without departing from the essential scope of the invention thereof.

It is therefore intended that the invention not be limited to the particular embodiment disclosed as the best more contemplated for carrying out the invention but that the invention will include all embodiments falling within the scope of the appended claims.

I claim:

1. A beverage container carrier device comprising a can clip element, a detachable grasping handle element, and a beverage bottle connector element, said can clip element further comprising:

a curved right and left lateral side, an upper middle substantially rectangular member;

a proximal loop member positioned atop said can clip element and having a substantially circular opening for reversibly securing said grasping handle element;

a bottom arm member; and a distal internal aperture member for slidingly receiving said beverage bottle connector element.

2. The device of claim 1 wherein said bottom arm member of said can clip element comprises an upwardly angled portion contiguous with a substantially rectangular section extending horizontally along the bottom side of said upper substantially rectangular member, said substantially rectangular section being separated from said upper middle substantially rectangular member member by a narrow substantially rectangular slot.

3. The device of claim 1 wherein said beverage bottle connector element comprises a flexible cord further comprising a plurality of substantially evenly spaced protrusions, a protrusion engagement hook at one end of said cord and an opposite free end wherein said free end is passed through said distal internal aperture member of said can clip element and then through said protrusion engagement hook to form a loop for engagement with the neck of a beverage bottle.

4. The device of claim 3 wherein said flexible cord includes a cord tightening fob for maintaining the tightness of said bottle neck engaging loop around the neck of a beverage bottle.

5. The device of claim 1 wherein said can clip element comprises one self-contained unit.

6. The device of claim 3 wherein said flexible cord of said beverage bottle connector element comprises a clasp affixed to said opposite free end for reversibly attaching said flexible cord to said distal internal aperture of said can clip element.

7. The device of claim 1 wherein said detachable grasping handle element comprises a cord inserted directly through said proximal loop member of said can clip element, said cord maintaining its circular shape when inserted through proximal loop member.

8. The device of claim 1 wherein said detachable grasping handle element comprises a flexible strap with a hooking means for securing said flexible strap to said proximal loop member of said clip can element.

9. The device of claim 1 wherein said clip can element is comprised of metal, a composite, stainless steel, plastic, or a combination thereof.

10. The device of claim 3 wherein said flexible cord is comprised of metal, a composite, stainless steel, plastic, or a combination thereof.

11. The device of claim 3 wherein said flexible cord loop tightening fob comprises plastic, metal, a composite, stainless steel, or a combination thereof.

* * * * *